US009751596B2

(12) United States Patent
Borel

(10) Patent No.: US 9,751,596 B2
(45) Date of Patent: Sep. 5, 2017

(54) DEVICE FOR LAUNCHING AND RECOVERING A TOWED SONAR

(71) Applicant: THALES, Courbevoie (FR)

(72) Inventor: Christophe Borel, Brest (FR)

(73) Assignee: THALES, Courbevoie (FR)

( * ) Notice: Subject to any disclaimer, the term of this patent is extended or adjusted under 35 U.S.C. 154(b) by 176 days.

(21) Appl. No.: 14/421,956

(22) PCT Filed: Jul. 15, 2013

(86) PCT No.: PCT/EP2013/064872

§ 371 (c)(1),
(2) Date: Feb. 16, 2015

(87) PCT Pub. No.: WO2014/026817

PCT Pub. Date: Feb. 20, 2014

(65) Prior Publication Data

US 2015/0239530 A1 Aug. 27, 2015

(30) Foreign Application Priority Data

Aug. 17, 2012 (FR) ..... 12 02250

(51) Int. Cl.
*B63B 21/66* (2006.01)
*B63B 27/36* (2006.01)
(Continued)

(52) U.S. Cl.
CPC ..... *B63B 21/66* (2013.01); *B63B 27/36* (2013.01); *B63G 8/39* (2013.01); *B63G 8/42* (2013.01)

(58) Field of Classification Search
CPC ..... G01V 1/38; B63B 21/66
See application file for complete search history.

(56) References Cited

U.S. PATENT DOCUMENTS 7,209,408 B1 4/2007 Stottlemyer et al.
8,104,419 B2 1/2012 Coupeaud et al.
(Continued)

FOREIGN PATENT DOCUMENTS

FR 2907263 A1 4/2008
GB 1522131 A 8/1978
(Continued)

OTHER PUBLICATIONS

Office Action issued in Japanese Patent Application No. 2015-526913 dated Apr. 4, 2017, with English translation.

*Primary Examiner* — Edwin Swinehart
(74) *Attorney, Agent, or Firm* — Baker & Hostetler LLP

(57) ABSTRACT

A device for launching and recovering a sonar is disclosed. The device has a linear receiving antenna and a volume transmitting antenna incorporated in a volume body called fish, the sonar being towed by a surface vessel by a towing line a towing cable from which the fish is suspended, and the linear antenna being secured behind the cable relative to the vessel. The device has a towing winch that includes a frame secured to the surface vessel, making it possible to wind and unwind the towing line around a reel. The reel includes two parts that are rotationally mobile about an axis of rotation, the two parts being coupled, the first part having a cylindrical form on which the towing line is intended to be wound, the second part forming a first abutment intended to accommodate the fish.

18 Claims, 5 Drawing Sheets

(51) Int. Cl.
*B63G 8/39* (2006.01)
*B63G 8/42* (2006.01)

(56) References Cited

U.S. PATENT DOCUMENTS

| | | | | |
|---|---|---|---|---|
| 2002/0056777 | A1* | 5/2002 | Lindeman ..... | B66D 1/7447<br>242/311 |
| 2009/0154295 | A1 | 6/2009 | Ricard et al. | |
| 2010/0064955 | A1 | 3/2010 | Coupeaud et al. | |

FOREIGN PATENT DOCUMENTS

| | | | |
|---|---|---|---|
| JP | 49-121256 | U | 10/1974 |
| JP | 4-107789 | U | 9/1992 |
| JP | 8-301550 | A | 11/1996 |
| JP | 9-21659 | A | 1/1997 |
| JP | 11-322281 | A | 11/1999 |
| JP | 2000-198678 | A | 7/2000 |
| JP | 2005-153595 | A | 6/2005 |
| JP | 2006-518951 | A | 8/2006 |

* cited by examiner

DEVICE FOR LAUNCHING AND RECOVERING A TOWED SONAR

CROSS-REFERENCE TO RELATED APPLICATIONS

This application is a National Stage of International patent application PCT/EP2013/064872, filed on Jul. 15, 2013, which claims priority to foreign French patent application No. FR 1202250, filed on Aug. 17, 2012, the disclosures of which are incorporated by reference in their entirety.

FIELD OF THE INVENTION

The present invention relates to the active sonars with variable immersion, pulled by a surface vessel. It relates more particularly to the towed active sonars in the form of bistatic devices in which the transmitting antenna is volumic and is incorporated in a volumic submersible object and the receiving antenna consists of a linear antenna (streamer) towed behind the transmitting antenna. These sonars are towed by means of a towing line which is, for example, partly formed by the linear antenna and to which the transmitting antenna is secured.

CONTEXT OF THE INVENTION—PRIOR ART

Implementing such a sonar comprises two handling steps, one consisting in launching the sonar from the surface vessel and the other consisting in recovering the sonar and stowing it on the pulling vessel.

On the surface vessels, the linear receiving antennas are traditionally stowed on a winch, for obvious reasons of bulk.

Conventionally, the launching of a sonar comprising both a transmitting antenna mounted in a pulled submersible craft, also called "fish", and a receiving linear antenna consists firstly in unwinding the linear antenna by actuating the winch and allowing the linear antenna to be emerged at the end of the towing cable. It then consists in mechanically and electrically coupling the fish to the towing line and then launching the fish.

Conversely, bringing such a sonar back on board the surface vessel consists firstly in hauling the towing line, then taking the fish out of the water and uncoupling the fish from the line. When the latter is uncoupled, the linear antenna which follows is pulled on board and wound on the winch.

The launching and the recovery of such a sonar therefore comprises a certain number of securing and unsecuring operations, that can be performed manually, which, depending on the weight of the transmitter, can entail mobilizing a fairly large number of operators. Now, when the sea conditions are difficult, in heavy weather, such operations, generally performed by crewmen from the rear platform of the vessel, can prove, for these men, very difficult, testing, even dangerous, such that launching or recovering of the sonar can be made impossible for safety reasons.

To circumvent these difficulties, one known solution consists in stowing, on two separate reels, the electrotraction cable which remains secured to the fish and the linear receiving antenna. This way, the launching of the sonar is performed by completely unwinding the linear receiving antenna (i.e. the "streamer") into the sea and by connecting, mechanically and electrically, the end of the streamer that is out of the water to the fish, at the end of unwinding and before full immersion. Once connected, the fish, attached to the streamer, is paid out into the sea by unwinding the electrotraction cable. However, the securing and unsecuring operations are replaced by operations of connecting and disconnecting (electrically and mechanically) the linear antenna and the part of the line comprising the fish. These operations are simpler than the securing and unsecuring operations but they still require the intervention of operators.

Another solution, designed to avoid the intervention of operators is described in the patent application FR0608998. It consists in providing a device for securing and automatically connecting a fish to the connecting line.

This solution does, however, present the drawback of requiring the installation, on the floating vessel, of heavy and bulky gear suitable for raising, lowering and stowing the fish. Moreover, any malfunctioning of the gear that makes it possible to raise, lower and stow the fish renders the device unusable which makes it unreliable.

The document GB 1 522 131 describes a device for launching and recovering a fish comprising a winch around which a towing cable can be wound and an arm suitable for ensuring the recovery of the fish.

SUMMARY OF THE INVENTION

The aim of the present invention is to remedy at least one of the abovementioned drawbacks.

To this end, the subject of the invention is a device for launching and recovering a sonar, comprising a linear receiving antenna and a volume transmitting antenna incorporated in a volume body called fish, said sonar being towed by a surface vessel by means of a towing line comprising a towing cable from which the fish is suspended, the linear antenna being secured behind the cable relative to the vessel, said device comprising a towing winch comprising a frame secured to the surface vessel and making it possible to wind and unwind the towing line around a reel. The reel comprises two parts that are rotationally mobile about an axis of rotation, means for coupling the two parts, the first part having a cylindrical form on which the towing line is intended to be wound, the second part comprising a first abutment intended to accommodate the fish.

Advantageously, the device comprises immobilization means, suitable for immobilizing the second part of the reel relative to the frame.

Advantageously, the second part of the reel comprises a globally cylindrical rigid casing whose axis is the axis of rotation and delimiting a housing suitable for receiving, at least radially, the fish, the casing making it possible to wind the cable on its outer surface.

Advantageously, the diameter of the casing is greater than the diameter of the first part of the reel.

Advantageously, the second part of the reel comprises bearing means and possibly sliding means against which the towing cable can slip, and possibly be guided.

Advantageously, the bearing means comprise a groove formed on the outer face of the casing.

Advantageously, the groove is configured in such a way as to be able to receive the towing cable in such a way that it does not protrude on the outer face of the casing.

Advantageously, the second part of the reel comprises first guiding means for guiding the towing line along a plane at right angles to the axis of rotation, on the second part of the reel at its exit from the wire guiding head, in the recovery phase, and before its entry into the wire guiding head, in the launching phase.

Advantageously, the device comprises wire guiding means comprising a wire guiding head, making it possible to guide the towing line, means for driving the wire guiding head, making it possible to move the wire guiding head parallel to the axis of rotation and means for driving the reel, suitable for pivoting the first part of the reel about the axis of rotation.

Advantageously, the means for driving the wire guiding head and the reel are configured in such a way as to wind the towing cable on the first part of the reel when the recovering of the sonar is initiated and until the first part of the reel has performed, about the axis of rotation and in the direction of winding, a number of turns, called reel turns, less than a predetermined first number of turns N1, relative to a predetermined initial position of the first part of the reel.

Advantageously, the means for driving the wire guiding head are configured in such a way as to immobilize the wire guiding head in a transfer position of the wire guiding head and the means for driving the reel are configured in such a way as to position the second part of the reel in a transfer position of the second part of the reel, said respective positions making it possible to transfer the fish from the wire guiding head to the first abutment, when the recovery of the sonar is initiated and when the number of reel turns is equal to a third number of turns N3 at least equal to the first number of turns N1.

Advantageously, the coupling means are configured in such a way as to couple the first part of the reel and the second part of the reel, the means for driving the wire guiding head and the reel are configured in such a way as to wind the towing cable around the second part of the reel on the bearing means when the recovery phase is initiated, once the number of reel turns has reached a number of reel turns equal to a second number of turns N2 at least equal to the first number of reel turns N1 and before it reaches the third number of reel turns N3.

Advantageously, the means for driving the wire guiding head and the reel are configured in such a way as to position the towing cable in such a way as to be guided by the first guiding means before the number of reel turns reaches the third number of turns N3.

Advantageously, when the recovery phase is initiated and when the number of reel turns has reached the third number of turns N3 and until the fish comes into abutment against the first abutment, the coupling means are configured in such a way as to uncouple the first part of the reel and the second part of the reel and the means for driving the reel are configured in such a way as to drive the first part of the reel in rotation so as to wind the towing cable around the reel.

Advantageously, the means for immobilizing the second part of the reel are configured in such a way as to immobilize the second part of the reel in its transfer position, when the number of reel turns has reached the number of turns N3 and until the fish comes into abutment against the first abutment.

Advantageously, the device comprises locking means suitable for keeping the fish bearing on the first abutment, and when the recovery phase is initiated and the fish is in abutment against the first abutment, the locking means are configured in such a way as to keep the fish bearing on the first abutment, the coupling means are configured in such a way as to couple the first part and the second part of the reel and the means for driving the wire guiding head and the reel are configured in such a way as to perform a winding of the towing line around the assembly formed by the first and second parts of the reel.

Advantageously, the device comprises second guiding means making it possible to maintain an inclination of the fish that is fixed relative to a plane at right angles to the axis of rotation when the attachment means pass through the wire guiding head.

Advantageously, the device comprises third guiding means making it possible to guide and keep the fish in the housing in a predetermined direction at right angles to the axis of rotation.

Another subject of the invention is a towing system comprising a deployment and launching device according to the invention and further comprising a linear receiving antenna and a volume transmitting antenna incorporated in a body called fish, and a towing line comprising a towing cable from which the fish is suspended and to which the linear antenna is secured behind the cable relative to the vessel, the towing cable being attached to said device.

DESCRIPTION OF THE FIGURES

Other features and advantages of the invention will become apparent on reading the following detailed description, given as a nonlimiting example and with reference to the attached drawings in which.

From one figure to another, the same elements are identified by the same references.

The terms "vertical", "horizontal", "front and rear" are determined relative to a reference frame linked to the ship.

DETAILED DESCRIPTION OF THE INVENTION

Figure 1:
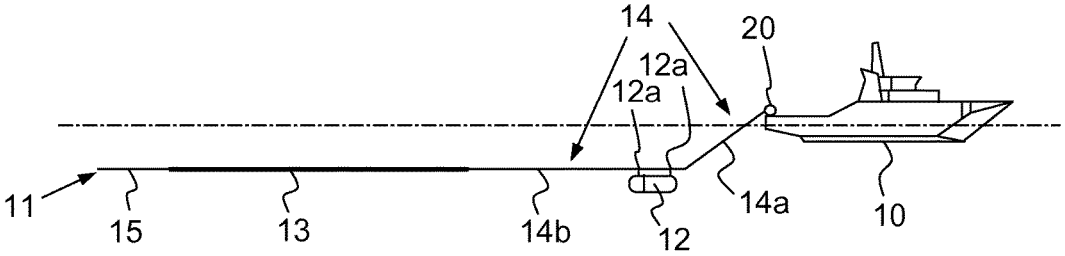
FIG. 1 represents a towing system according to the invention.

FIG. 1 schematically represents a surface vessel 10 which is, here, a ship pulling an active sonar by means of a towing line 11. The sea level is represented by chain-dotted lines.

The sonar comprises a linear receiving antenna 13 which is a receiving antenna with neutral buoyancy. It also comprises a volume transmitting body 12, called fish, incorporating an acoustic volume transmitting antenna mounted in a submersible object, which is also volumic.

The fish 12 is suspended from the towing line 11 by means of attachment means 12*a* while the linear receiving antenna is incorporated in the towing line 11.

The towing line 11 comprises an electrotraction towing cable 14, the linear antenna 13 and an end cable 15. The fish 12 and the linear antenna 13 are mechanically secured and electrically and/or optically connected to the towing cable 14. The fish 12 is suspended from the electrotraction cable 14. For its part, the linear antenna 13 is fixed at the end of the electrotraction cable 14. It extends linearly between the electrotraction cable 14 and an end cable 15 forming the free end of the towing line 11.

The cable 14 also ensures the routing of signals and of the power supply between the ship 10 and the antennas 12 and 13.

In the embodiment of FIG. 1, the towing cable 14 comprises a first end attached to the ship and a second end fixed to the linear antenna 13. In other words, the linear receiving antenna 13 is towed behind the fish, relative to the ship 10. The electrotraction cable 14 comprises a heavy cable 14*a* attached to the ship at one of its ends and a light cable 14*b* at its other end, the fish 12 and the linear antenna 13 being secured to the light cable (which has a density less than the density of the heavy cable).

During a submarine acoustic mission, the antenna of the fish 12 emits sound waves in the water and the receiving antenna 13 picks up any echoes originating from targets on which the sound waves from the fish 12 are reflected.

The device for launching and recovering the sonar according to the invention comprises a towing winch 20 arranged on the deck of the ship 10 and being secured thereto.

Figure 2A:
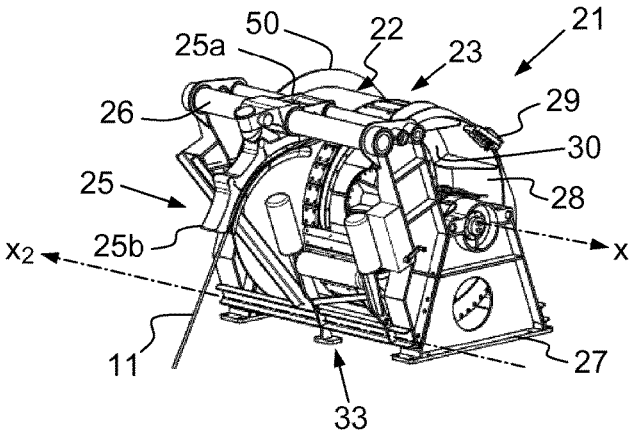
FIGS. 2*a*, 2*b* and 2*c* schematically represent a device for launching and recovering a sonar according to the invention in perspective (FIGS. 2*a* and 2*b*) and in side view, at right angles to the axis of rotation (FIG. 2*c*) of the reel of the device, FIGS. 3*a* to 3*f* schematically represent, in perspective and in side view, a device for launching and recovering a sonar according to the invention in a recovery phase before the fish arrives in the wire guiding head (FIGS. 3*a* and 3*b*), when the fish suspended from the towing line passes into the wire guiding head (FIGS. 3*c* and 3*d*) and when it arrives against the first abutment (FIGS. 3*e* and 3*f*), FIGS. 4*a* and 4*b* schematically represent, in perspective and in plan view, the device according to the invention when the second part of the reel is in waiting position, FIG. 5 schematically represents, in plan view, the device according to the invention when the part of the cable situated in front of the fish is spooled around the first part of the reel, FIG. 6 schematically represents different elements of the device according to the invention, not visible, for the most part, in the preceding figures.
Figure 2B:
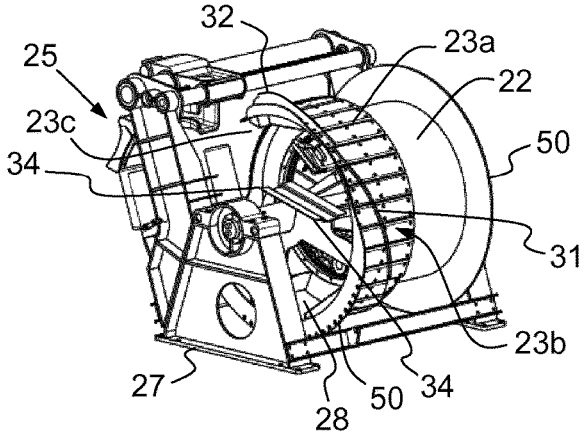
Figure 2C:
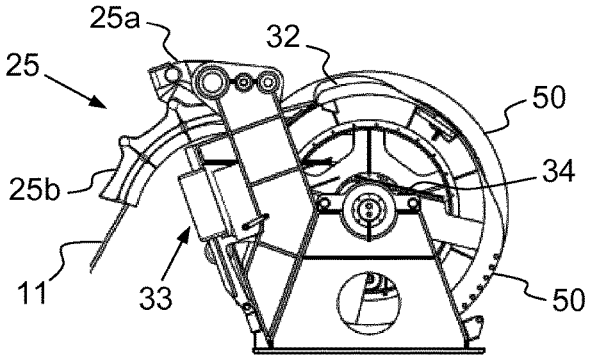

FIGS. 2*a* to 2*c* show different views of the winch 20. The winch 20 comprises a frame 27 secured to the ship 10 and a drum or reel 21 suitable for pivoting relative to the frame about an axis of rotation x. The winch advantageously comprises means for driving ENT1, 100 the reel 21, represented in FIG. 6, making it possible to drive a first part of the reel 22 in rotation about the axis x relative to the frame 27 to wind and unwind the towing line around the reel 21.

The reel 21 comprises the first part 22 and a second part 23. These parts are adjacent along the axis of rotation x. They occupy predetermined respective axial positions on the axis x, relative to the frame 27.

The first and second parts 22, 23 are both rotationally mobile about the axis x relative to the frame 27. The first part 22 has a cylindrical form of axis x on which the towing line 11 is intended to be wound. The second part 23 comprises a first abutment 28, visible in FIG. 2*a*, intended to accommodate the fish 12, that is to say on which the fish is intended to come into abutment, that is to say to bear. The device further advantageously comprises locking means 29 making it possible to lock the position of the fish 12 relative to the first abutment 28 when the latter is in abutment against the first abutment 28.

Figure 3A:
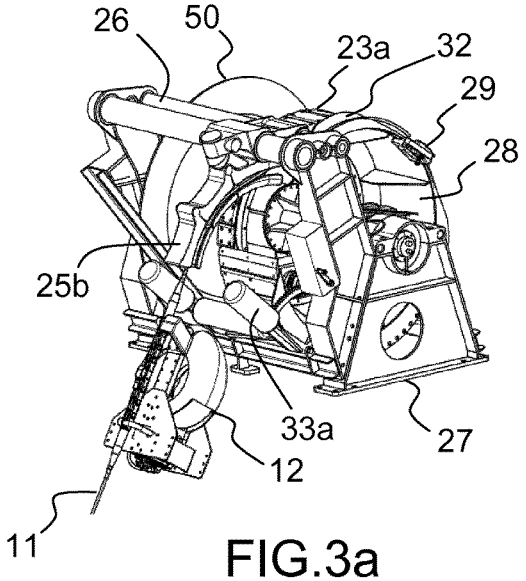
Figure 3B:
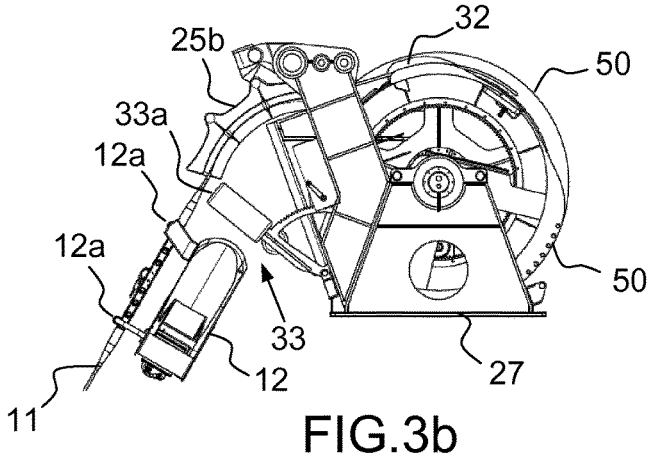
Figure 3C:
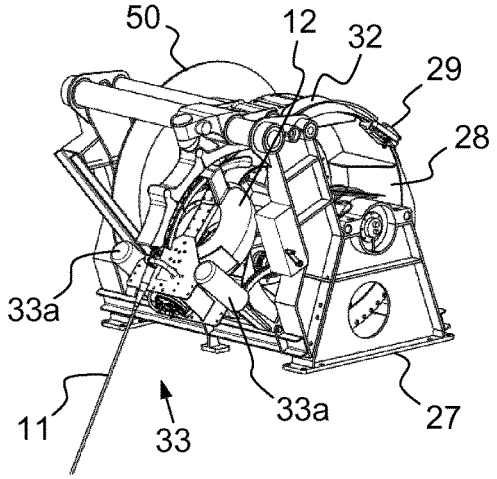
Figure 3D:
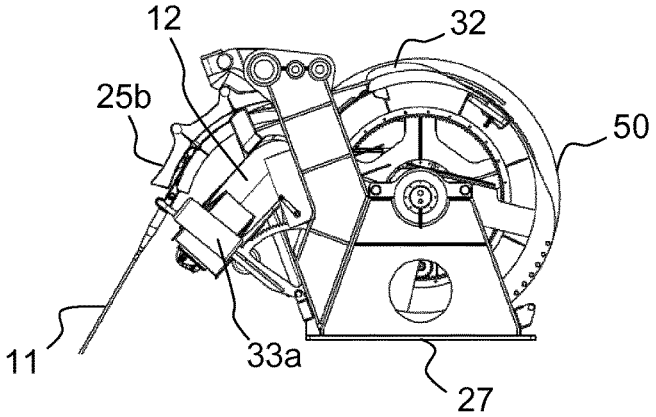
Figure 3E:
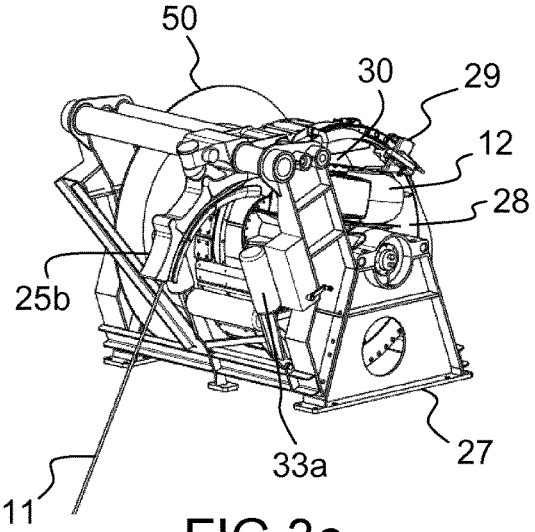
Figure 3F:
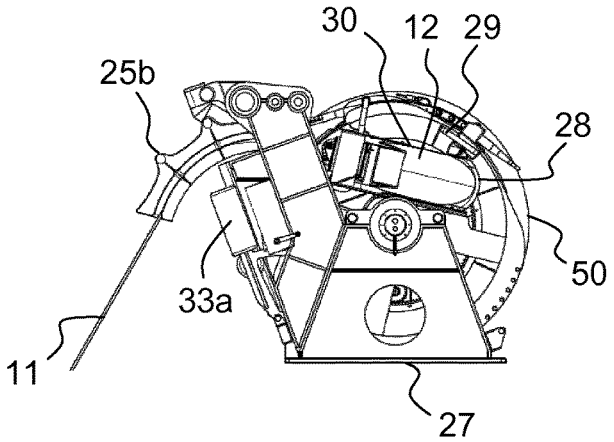

In the particular embodiment of the figures, as can be seen in FIG. 2*b*, the second part 23 of the reel 21 advantageously comprises a globally cylindrical rigid casing 23*a* of axis x delimiting a housing 30 suitable for receiving, at least radially, that is to say at right angles to the axis x, the fish 12 (as is represented in FIGS. 3*e* and 3*f*). In other words, the rigid casing 23*a* is configured to receive the fish 12 in its diameter. The casing is arranged in such a way that, when the fish comes into abutment against the first abutment 28, the fish 12 is housed at least radially in the housing 30.

The casing 23*a* has an opening 23*c* that can be seen in FIG. 2*a* allowing for the passage of the fish between the housing 30 and the outside of the housing 30 by a movement in a plane at right angles to the axis x. The opening is, in the embodiment of the figures, produced in the form of an undercut. The casing 23*a* could also be pierced with a hole forming the opening 23*a*.

The housing 30 is advantageously suitable for receiving the fish in the radial direction and in the axial direction as is represented in FIGS. 3*e* and 3*f*. In other words, the housing is configured to receive all of the fish 12 in the housing 30.

In this embodiment, the fish 12, once it is housed in the housing 30, that is to say stowed in the rigid casing 23*a*, as is represented in FIGS. 3*e* and 3*f*, does not protrude, relative to the rigid casing 23*a* in the axial direction, which favors the compactness of the device.

Advantageously, the casing 23*a* allows the towing line to be wound on its outer surface.

The second part of the reel 23 advantageously comprises bearing means 31, visible in FIG. 2*b*, against which the towing cable 14 can slip between a wire guiding head 25 and the first part of the reel 22. Advantageously, the bearing means 31 are provided with a coating favoring the slippage, for example made of high-density polyethylene (HDPE).

Figure 4A:
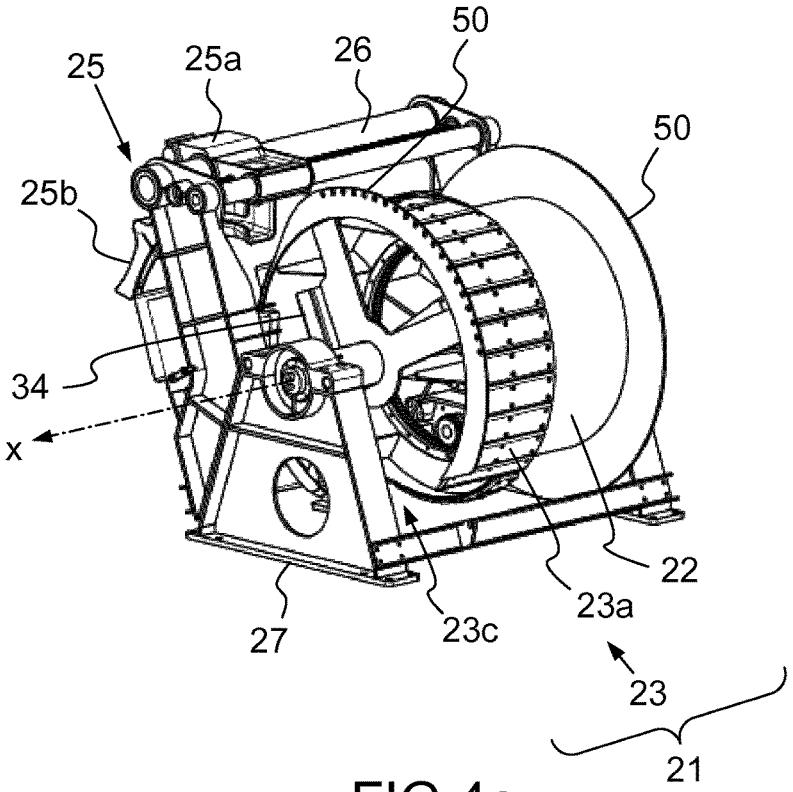
Figure 4B:
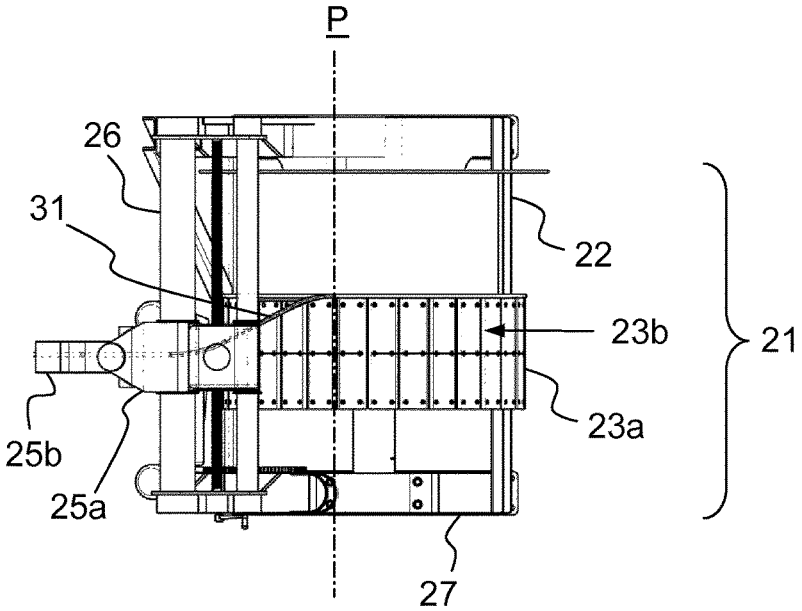

In the embodiment of the figures, these bearing means 31 are produced in the form of a groove 31 formed on the outer face 23*b* of the casing 23*a*. The outer face 23*b* is the face of the casing 23*a* which faces toward the outside of the cylinder. As can be seen in FIG. 4*b*, the groove 31 emerges facing the first part of the reel 22. In FIGS. 4*a* and 4*b*, the second part of the reel 23 is represented in a waiting position in which the groove 31 emerges at the level of the plane of separation P which is the vertical plane in which the towing cable separates from the reel 21 to join the wire guiding head 25. In this position, the opening 23*c* faces toward the bottom of the winch.

The groove 31 and, more generally, the bearing means 31, are advantageously arranged in such a way as to allow the cable 14 to be wound around the second part 23 moving away from an end of the second part 23 situated in contact with the first part 22. As can be seen in FIG. 2*b*, the groove 31 is of helical form.

In a variant, the casing 23 does not have a groove and the bearing means comprise the outer face 23*b* of the casing 23*a*. The casing is, in this case, advantageously smooth and possibly coated with a coating favoring the slippage.

In the case where the bearing means are produced in the form of a groove 31, they also serve as a sliding means in which the towing cable 14 can slide. This makes it possible to avoid any offsetting of the cable 14 toward the first part of the reel 22 during the slippage. These means could be produced differently, for example by means of pulleys. In this case, the bearing means are also sliding means.

In the embodiment of the figures, the groove 31 is arranged in such a way as to be able to receive the towing cable 14 and possibly the attachment means 12*a* in such a way that they do not protrude on the outer face 23*b* of the casing 23*a*. In other words, the dimensions of the groove are defined as a function of those of the cable.

The reel 21 is provided with flanges 50, the function of which is to prevent the towing line from leaving the reel when it is wound around the reel.

Figure 6:
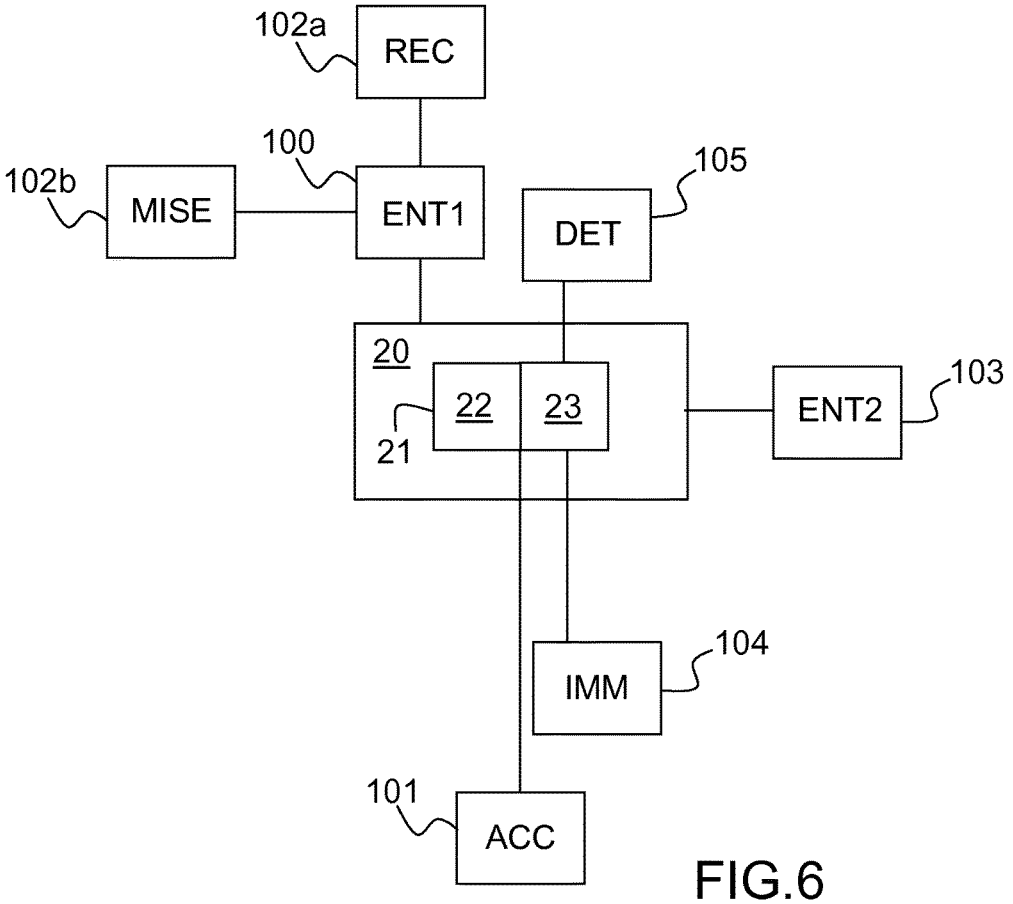

The device according to the invention further comprises coupling means ACC, 101, represented in FIG. 6, making it possible to couple and uncouple the two parts 22, 23 of the reel 21. When the two parts 22, 23 are coupled, they are secured in rotation about the axis x relative to the frame 27 but not when they are uncoupled. The coupling means 101 are conventional means to those skilled in the art which are, for example, produced in the form of a clutch or else based on a brake coupled to a jaw secured to one of the parts or even on a motor coupled to a toothed crown ring.

The means for driving the reel 100 are dimensioned in such a way as to be able to rotationally drive the two parts of the reel 22, 23 together.

The device according to the invention makes it possible to launch and recover a sonar comprising a linear antenna and a fish without requiring any operation of securing or unsecuring the fish, but only using a control or an intelligent configuration of the different means of the device. It thus offers the advantage of being reliable. It is moreover compact and lightweight since it does not require installation, on the floating vessel, of equipment items other than a winch, notably for stowing the fish.

In an advantageous embodiment, the winch 20 comprises wire guiding means comprising a wire guiding head 25 in which the towing line 11 and the attachment means 12*a* are able to slide.

The wire guiding means 24 make it possible to correctly position the towing line on the reel in order for the turns generated in the winding to be arranged in an ordered manner, that is to say turn by turn, in such a way that two adjacent turns are contiguous, and layer by layer.

The function of the wire guiding head 25 is to guide the towing line in such a way as to ensure that the portion of the towing line 11 presented to the reel 21 is oriented at right angles to the axis of rotation x to allow a correct arrangement of the turns. The wire guiding head 25 advantageously comprises an articulated fairlead 25*b* suspended from the guides 26 via a sliding assembly 25*a* suitable for sliding along guides 26 extending parallel to the axis x.

The wire guiding means 24 comprise means for driving the wire guiding head ENT2, 103 making it possible to move, along the guides 26, along an axis parallel to the axis of rotation x along the reel 21 in both directions. The wire guiding head is guided by means of the guides 26.

More particularly here, the means for driving the wire guiding head 103 make it possible to move the wire guiding head 25 along first and second parts of the reel 22, 23, along the axis x in both directions.

The device advantageously comprises first means REC, 102*a*, represented in FIG. 6, making it possible for the operator to initiate the recovery of the sonar and second means MISE, 102*b*, not represented, making it possible for an operator to initiate the launching of the sonar. These are, for example, buttons for initiating these two phases.

The coupling means 101, the means for driving the reel 100 and the wire guiding head 103, as well as the locking means 29 and immobilization means IMM, 104, which will be described later, advantageously comprise automatic control means which can be configured according to predetermined configurations. When an operator initiates the recovery or the launching, they then operate according to their respective configurations.

As a variant, the device comprises control means, making it possible for an operator to control the means cited in the preceding paragraph.

There now follows a description of an exemplary mode of operation of the device according to the invention and a description of the additional features of the device according to the invention.

More specifically here, an exemplary mode of operation of the device is described in the phase of recovery of the sonar 12, 13 which is immersed and towed by means of the towing line 11.

First of all, an operator initiates the recovery of the sonar by means of the first means described previously.

To carry out the recovery phase, the towing cable 14*a* must first be wound onto the reel 21. This phase must be carried out in such a way as not to block the subsequent access of the fish 12 to the abutment 28.

The means for driving the wire guiding head and the reel are advantageously configured in such a way as to wind the towing cable 14 onto the first part of the reel 22, and more particularly the part of the cable 14*a* situated in front of the fish 12, until the first part of the reel has performed, about the axis x and in the direction of winding, a number of turns, called reel turns, less than a predetermined first number of turns N1, relative to a predetermined initial position of the first part of the reel.

The winding is advantageously performed in an ordered manner. Hereinafter in the text, the expression "number of reel turns" should be understood to mean the number of turns performed by the first part of the reel in the winding, relative to a predetermined initial position.

The first number of turns N1 is determined in such a way that the arrival of the fish 12 at the wire guiding head 25 is close. N1 is, for example, determined as a function of the distance separating, along the towing cable 14, the end of the towing cable which is fixed to the ship 10 and the position of the fish 12 when the towing cable 14 is slack such that, when the number of reel turns is equal to N1, the distance separating the fish 12 and more particularly the attachment means 12 of the wire guiding head 25, when the cable 14 is slack, is less than a predetermined first threshold distance. The system advantageously comprises means for counting the number of turns of the reel and for comparing them to one or more predetermined numbers of turns.

In this step of winding of the cable around the first part 22 of the reel, the coupling means 101 are advantageously configured in such a way as to couple the two parts 22, 23 of the reel 21. In other words, the two parts of the reel 22, 23 turn together. The first and second parts are advantageously arranged in such a way that, when the number of reel turns is equal to N1, the second part of the reel is in the waiting position represented in FIGS. 4*a* and 4*b*. In this position, it is possible to insert the towing cable into the groove 31.

It would be possible, as a variant, to configure the system in such a way as to turn only the first part 22 of the reel until the number of reel turns reaches N1 and position the second part of the reel in its waiting position.

Figure 5:
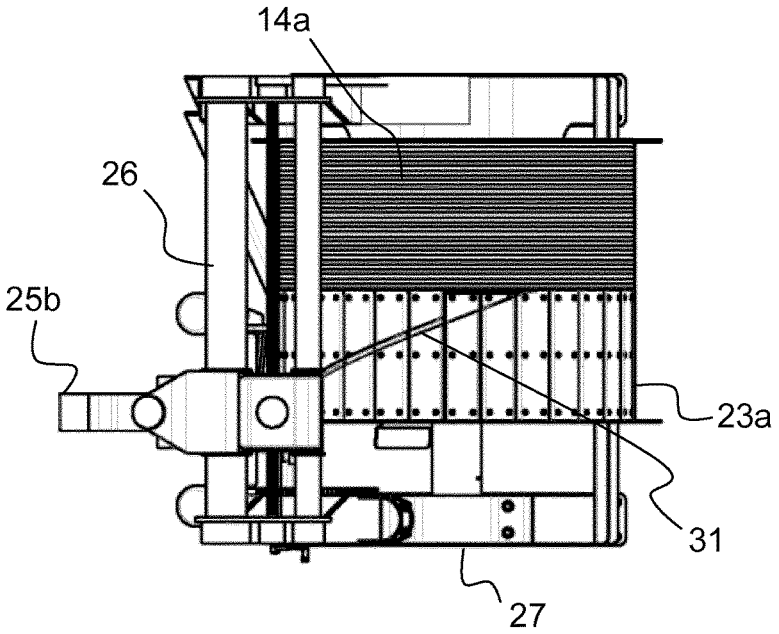

The coupling means are configured in such a way as to uncouple the two parts of the reel 22, 23, the means for driving 100 the reel and the means for driving the wire guiding means 103 are advantageously configured in such a way as to drive the second part 23 of the reel in rotation while bringing the wire guiding head 25 to face the second part of the reel 23 in such a way as to insert the towing cable 14 into the groove 31, once the number of reel turns has reached N1 and the second part of the reel is in its waiting position and until the number of reel turns reaches a second number of turns N2 greater than N1. This configuration is represented in FIG. 5.

The device according to the invention advantageously comprises immobilization means IMM, 104, produced, for example, in the form of a brake or a clutch, making it possible to immobilize the second part 23 of the reel 21 relative to the frame 27. These means are advantageously configured in such a way as to immobilize the second part of the reel 23.

The second part of the reel 23 is provided with a second abutment 32 which can be seen in FIG. 2*c* and in FIGS. 3*a* to 3*e*. This second abutment serves as first guiding means suitable for guiding the towing line 11 on a plane at right angles to the axis x on the second part of the reel 23 at its exit from the wire guiding head 25 (in the recovery phase) and before its entry into the wire guiding head 25 (in the launching phase) when the second part of the reel is in a transfer position which will be described later. The first guiding means could be produced in another form. For example, the first guiding means can be formed by the groove. In this case, the groove must be dimensioned in such a way as to be able to receive the attachment means by slippage.

Once the number of reel turns has reached the second number N2, the coupling means 101 are configured in such a way as to couple the two parts 22, 23 of the reel, and the means for driving the wire guiding head 103 and the means for driving the reel 100 are configured in such a way as to wind the towing cable 14 on the groove 31 (that is to say on the bearing means 31), advantageously to come to place the towing cable in abutment against a second abutment 32 (that is to say come to position the towing cable in such a way as to be guided by the first guiding means 32), and then to come to immobilize the second part of the reel 23 and the wire guiding head 25 in respective transfer positions making it possible to transfer the fish 12 from the wire guiding head to the first abutment 28 (and vice versa).

The transfer positions of the wire guiding head 25 and of the second part of the reel 23 are represented in FIG. 2*b*. When the second part 23 of the reel is in its transfer position, the opening 23*c* faces the wire guiding head 25. When the wire guiding head 25 is in its transfer position, it faces the abutment 28. More specifically, in the embodiment of FIGS. 3*a* to 3*c*, it is positioned, on the axis x, so as to allow the fish 12 to pass through the opening 23*c*.

Hereinafter in the text, "first direction" and, respectively, "second direction", are used to describe the direction of translation along the axis x oriented from the first part 22 to the second part of the reel 23, respectively from the second part 23 to the first part 22 of the reel.

In a nonlimiting particular configuration, the two parts of the reel 22, 23 are, for example, made to turn at the same time as the wire guiding head 25 is translated in the first direction, so as to wind the cable 14 on the groove 31, and until the cable 14 is located on the other side of the second abutment 32. The reel 21 is then immobilized and the wire guiding head 25 is translated in the second direction so as to come to place the cable 14 bearing against the second abutment 32 and place the wire guiding head 25 facing the second part of the reel 23 in its transfer position. Then, the reel 21 is turned until the opening 23*c* is correctly positioned relative to the wire guiding head, that is to say in its transfer position.

At the end of this step, the number of turns performed by the reel is equal to a third number of turns N3. Here, N3 is greater than N1 and N2. The transfer position of the second part of the reel is, for example, determined as a function of the number of reel turns, when the number of reel turns is equal to N3.

There now follows a description of the step of recovery of the fish 12 at its exit from the wire guiding head 25.

Advantageously, once the wire guiding head 25 and the second part of the reel 23 are immobilized in their respective transfer positions and, until the fish 12 arrives in abutment against the first abutment 28, the coupling means 101 are configured in such a way as to uncouple the two parts of the reel, the immobilization means 104 are advantageously configured in such a way as to immobilize the second part of the reel 23 and the means for driving the reel 21 100 are configured in such a way as to drive the first part of the reel 22 in rotation so as to wind the towing cable 14 around the reel 21. The device is advantageously provided with means 105, DET, that make it possible to detect the moment when the fish 12 arrives in abutment against the abutment 28.

What happens then is represented in FIGS. 3*a* to 3*f*, the fish 12 is initially located behind the wire guiding head 25 (FIG. 3*a*, 3*b*). As the first part of the reel 22 turns, the attachment means 12*a* pass through the wire guiding head 25 (FIG. 3*c*, 3*d*) then the second abutment 32 while the fish 12 passes through the opening 23*c* and penetrates into the housing 30 (FIGS. 3*e*, 3*f*). The fish 12 comes into abutment against the first abutment 28.

The locking means 29 keep the fish 12 bearing on the abutment 28.

During this step, the towing cable 14 slips in the groove 31 and is wound around the first part of the reel 22. This concerns only a few meters of cable 14 out of the hundreds or thousands of meters that the cable can measure.

It is recalled here that the length of the towing line varies as a function of the speed of the ship and the sea conditions This length variation is due to the elasticity of the towing line. A towing cable 14 of approximately 1000 m can undergo a length variation of more than a meter. These length variations must be taken into account in order to be able to correctly recover the fish 12. The device must be configured correctly so as not to perform, before the recovery of the fish 12, a winding which would block the access of the fish 12 to the opening 23*c* and more particularly to the first abutment 28. It is also essential to correctly position the first abutment 28 (and the opening 23*c*) so that, on its arrival, the fish 12 can come into abutment against the first abutment 28.

The device according to the invention therefore makes it possible to ensure a correct recovery of the fish 12 and of the sonar all together even if the length of the towing cable 14 varies. It does not however require any implementation of a very accurate synchronization of the moment when the wire guiding head 25 and the first abutment 28 are correctly positioned relative to one another with the actual arrival of the fish 12 at the wire guiding head 25. If the towing cable 14 is stretched, the fish arrives at the wire guiding head at the moment when the wire guiding head and the first abutment are correctly positioned relative to one another. In this case, the cable 14 slips on the groove 31 and is wound on the first part of the reel 22, until the fish 12 comes into abutment against the first abutment 28. N3 is also determined in such a way that, when the number of turns is equal to N3, the distance separating the fish 12 from the wire guiding head 25, when the cable 14 is slack, is less than a predetermined second threshold distance less than the first threshold distance.

By immobilizing the second part of the reel 23 in its transfer position and not only positioning it in this position it becomes possible to guarantee that the fish 12 comes into abutment against the first abutment 28 after it has passed through the wire guiding head 25. It would be possible, in a less advantageous variant, to only position the second part of the reel 23 in this position and not provide the device with immobilization means.

Since the groove 31 serves as sliding means, as seen previously, it favors the guiding of the cable during the slippage.

Advantageously, as can be seen in FIGS. 3*a* to 3*f*, the device comprises second guiding means 33 making it possible to keep the inclination of the fish 12 fixed relative to a plane at right angles to the axis of rotation x when the attachment means 12*a* pass through the wire guiding head 25. This feature makes it possible to ensure an effective entry of the fish into the housing even if the sea is rough since they prevent the fish from pivoting about the towing line.

In the embodiment of the figures, these second guiding means comprise two arms 33*a* suitable for pivoting relative to the frame 27 about a second axis x2 (visible in FIG. 2*a*) parallel to the axis of rotation x between a lowered position (FIGS. 3*a* and 3*b*) and a raised position (FIGS. 3*e* and 3*f*). These arms are arranged in such a way as to grip the fish between these two positions that are chosen in such a way as to grip the fish when the attachment means pass through the wire guiding head.

Advantageously, as can be seen in FIG. 2*b*, the device comprises third guiding means 34 making it possible to guide and keep the fish 12 in the housing 30 in a predetermined direction at right angles to the axis x. This rail and the locking means 29 make it possible to immobilize the fish in its housing 30 because there is thus no longer the possibility of movement in the axial direction, or relative to the first abutment. Thus, the roll of the boat does not produce any movement of the fish. In the nonlimiting embodiment of the figures, the third guiding means are produced in the form of a guiding rail 34 arranged in the housing 30.

In the configuration previously described, N2 and N3 are different. In other words, the first 22 and second 23 parts of the reel are turned secured together, between the end of the phase of winding of the towing cable 14 around the first part of the reel 22 and the moment when the second part of the reel 23 and the wire guiding head 25 are in their respective transfer positions. This configuration makes it possible to position the towing cable in abutment against the second abutment 32 without having to provide means making it possible to lower or raise the wire guiding head 25. It also makes it possible to limit the forces on the second abutment 32 (or second guiding means), or on the wire guiding head (if the device has no second guiding means 32). In effect, if the wire guiding head 25 were to be positioned facing the second part of the reel 23 at the end of the step of winding around the first part of the reel 22 without pivoting the reel, the towing cable 14 would exert a significant force on the second abutment (or second guiding means) in the axial direction (or on the wire guiding head 25) and therefore on the means for driving the reel. However, as a variant, the device can be arranged and configured in such a way that N2=N3 and possibly N1.

The embodiment of the figures, in which the groove 31 does not serve as second abutment 32, is advantageous in that it makes it possible to provide an abutment 32 of larger size and thus correctly guide attachment means 12*a* of a size larger than the diameter of the cable 14*a*. The groove 31 makes it possible to control the area of slippage of the cable and therefore limit the length of the groove, that is to say the length over which the cable will slip on the second part of the reel during the phase of recovery of the fish. Now, it is advantageous to limit this length to avoid causing excessive friction with the towing cable on the second part of the reel 23 which could make the transfer of the fish 12 difficult.

Advantageously, the groove 31 or the bearing means extend over an aperture angle of between 30° and 270° around the axis x.

Once the fish 12 is in abutment against the abutment 28, there remains a phase of recovery of the end of the towing cable 14, of the linear antenna and of the end cable 15.

The locking means 29 are configured in such a way as to keep the fish 12 in abutment against the first abutment 28 when it is in abutment against said first abutment 28.

The coupling means 101 are advantageously configured in such a way as to couple the two parts 22 and 23 of the reel. The means for driving the wire guiding head 103 and the means for driving the reel 100 are advantageously configured in such a way as to perform a winding, preferably ordered, of the towing line 11 around the assembly formed by the first and second parts of the reel 22, 23.

Since the fish 12 is not unsecured when it is in its housing, it is necessary to turn the two parts of the reel together. The winding of the towing line around the two parts of the reel makes it possible to produce a compact device, since it uses all the length of the reel, even the part which houses the fish.

This advantage is obtained by virtue of the cylindrical form of the casing around which a cylindrical or quasi-cylindrical (because of the opening) winding is possible. As a variant, the means of the device are configured in such a way as to wind the part of the towing line situated behind the fish 12 around the first part of the reel. Such is, for example, the case when the first part of the reel 23 has no casing 23*a*.

The arrangement of the groove such that the towing cable does not protrude on the outer face of the casing makes it possible to avoid damaging the part of the cable which is located in the groove during the winding of the rest of the towing line. It also makes it possible to be able to obtain a well ordered arrangement of the turns.

Advantageously, as can be seen in FIG. 2*b*, the outer diameter of the casing is greater than the outer diameter of the first part of the reel. This makes it possible to favor the ordered arrangement of the turns around the reel.

Advantageously, the difference between the outer diameter of the casing and the outer diameter of the first part of the cylinder is substantially equal to the thickness needed to wind the towing cable in an ordered manner around the first part of the reel by performing a number of reel turns equal to the second number of turns N2 (which can be equal to N1). When the number of reel turns is equal to N2, the surface formed by the winding of turns and the casing is a quasi-cylindrical surface which makes it possible to ultimately obtain a particularly well ordered arrangement of turns.

There now follows a description of a use of the device according to the invention in the phase of deployment or launching of the sonar.

An operator has previously initiated this step by means of the second initiation means.

The means for driving the wire guiding means 103 are advantageously configured in such a way as to align the guiding means with the turn which is currently being unwound on the reel 21.

The part of the towing line 11 which is positioned behind the fish 12 must first of all be unwound.

The coupling means 101 are advantageously configured in such a way as to couple the two parts of the reel together, and the means for driving the reel 100, in such a way as to unwind the towing line until the number of turns performed by the reel about the axis x, relative to an initial position, in the direction of winding, is greater than a fourth number of turns N4 substantially corresponding to the number of turns performed by the reel 21 when the fish 12 comes to touch the first abutment 28 in the winding phase.

To this end, the device advantageously comprises means that make it possible to memorize the number of reel turns at the time when the fish comes to bear against the abutment in the recovery phase.

When the number of reel turns is equal to N4, the linear antenna is unwound and launched, and it is the turn of the fish to be launched.

The means for driving the wire guiding means 103 and the possible immobilization means 104 are advantageously configured in such a way as to immobilize the wire guiding head 25 and the second part of the reel 23 in their respective transfer positions when the number of turns is equal to N4 (FIGS. 3*e* and 3*f*). This configuration makes it possible to expel the fish from its housing 30.

The coupling means 101 are configured in such a way as to uncouple the two parts 22, 23 of the reel, the possible immobilization means 104 are advantageously configured in such a way as to immobilize the second part of the reel, and the means for driving the reel 100 are configured in such a way as to drive the first part of the reel 22 in rotation so as to unwind the towing cable 14 from the moment when the wire guiding head 25 and the second part of the reel are immobilized in their respective transfer positions and as long as the fish 12 is not situated beyond the wire guiding means relative to the reel 21, for example, until the number of reel turns reaches a fifth number of turns N5, for example, equal to the third number of turns N3 or less than N1.

The hydrodynamic drag produced by the immersed part of the towing line generates a pulling force on the fish 12. The reel unwinds the cable and, together with the pulling force generated by the hydrodynamic drag, generates a pulling force on the fish 12 capable of extracting the fish 12 from its housing 30 or from the first abutment 28. In this way, the fish 12 leaves the housing 30, passes through the wire guiding head and becomes immersed.

In the phase of immobilization of the first part of the reel during which the fish is extracted from its housing, the towing cable slips in the groove.

When the fish is extracted from its stowage position, the first part of the reel (coupled or not to the second part of the reel) is advantageously turned in such a way as to unwind the towing cable until the requisite immersion for the sonar is obtained.

Another subject of the invention is a towing system comprising a device for deploying and launching according to the invention and a sonar comprising a linear receiving antenna 13, a volume emitting antenna incorporated in a volume body in such a way as to form a volume body 12, called fish, and a towing line 11 comprising a towing cable 14 from which the fish 12 is suspended and to which the linear antenna 13 is secured behind the cable 14 relative to the vessel 10, the towing cable 14 being attached to said device.

The invention claimed is:

1. A device for launching and recovering a sonar, comprising a linear receiving antenna and a volume transmitting antenna incorporated in a volume body called fish, said sonar being towed by a surface vessel by means of a towing line comprising a towing cable from which the fish is suspended, the linear antenna being secured behind the cable relative to the vessel, said device comprising a towing winch comprising a frame for securing the surface vessel and making it possible to wind and unwind the towing line around a reel, wherein the reel comprises two parts that are rotationally mobile about an axis of rotation, means for coupling the two parts, a first part having a cylindrical form on which the towing line is intended to be wound, a second part comprising a first abutment intended to accommodate the fish.

2. The device for launching and recovering a sonar as claimed in claim 1, comprising immobilization means, suitable for immobilizing the second part of the reel relative to the frame.

3. The device for launching and recovering a sonar as claimed in claim 1, in which the second part of the reel comprises a globally cylindrical rigid casing whose axis is the axis of rotation and delimiting a housing suitable for receiving, at least radially, the fish, the casing making it possible to wind the cable on its outer surface.

4. The device for launching and recovering a sonar as claimed in claim 3, in which the diameter of the casing is greater than the diameter of the first part of the reel.

5. The device for launching and recovering as claimed in claim 1, in which the second part of the reel comprises bearing means and against which the towing cable can slip.

6. The device for launching and recovering as claimed in claim 5, in which the bearing means comprise a groove formed on the outer surface of the casing.

7. The device for launching and recovering as claimed in claim 6, in which the groove is configured in such a way as to be able to receive the towing cable in such a way that it does not protrude on the outer surface of the casing.

8. The device for launching and recovering a sonar as claimed in claim 1, in which the second part of the reel comprises first guiding means for guiding the towing line along a plane at right angles to the axis of rotation, on the second part of the reel at its exit from a wire guiding head in a recovery phase, and before its entry into the wire guiding head, in a launching phase.

9. The device for launching and recovering a sonar as claimed in claim 1, comprising wire guiding means comprising a wire guiding head, making it possible to guide the towing line and means for driving the wire guiding head, making it possible to move the wire guiding head parallel to the axis of rotation, the device further comprising means for driving the reel, suitable for pivoting the first part of the reel about the axis of rotation, the means for driving the wire guiding head and the reel being configured in such a way as to wind the towing cable on the first part of the reel when the recovering of the sonar is initiated and until the first part of the reel has performed, about the axis of rotation and in the direction of winding, a number of turns, called reel turns, less than a predetermined first number of turns N1, relative to a predetermined initial position of the first part of the reel.

10. The device for launching and recovering as claimed in claim 1, comprising wire guiding means comprising a wire guiding head, making it possible to guide the towing line and means for driving the wire guiding head, making it possible to move the wire guiding head parallel to the axis of rotation, the device further comprising means for driving the reel, suitable for pivoting the first part of the reel about the axis of rotation, in which the means for driving the wire guiding head are configured in such a way as to immobilize the wire guiding head in a transfer position of the wire guiding head and the means for driving the reel are configured in such a way as to position the second part of the reel in a transfer position of the second part of the reel, said respective positions making it possible to transfer the fish from the wire guiding head to the first abutment, when the recovery of the sonar is initiated and when a number of turns N3 is at least equal to a number of turns N1.

11. The device for launching and recovering a sonar as claimed in claim 10, in which the second part of the reel comprises bearing means against which the towing cable can slip, and in which the bearing means comprise a groove formed on the outer surface of the casing, and in which the coupling means are configured in such a way as to couple the first part of the reel and the second part of the reel the means for driving the wire guiding head and the reel are configured in such a way as to wind the towing cable around the second part of the reel on the bearing means when a recovery phase is initiated, once the number of reel turns has reached a number of reel turns equal to a number of turns N2 at least equal to the first number of reel turns N1 and before it reaches the number of reel turns N3.

12. The device for launching and recovering a sonar as claimed in claim 8, in which the means for driving the wire guiding head and the reel are further configured in such a way as to position the towing cable in such a way as to be guided by the first guiding means before a number of reel turns reaches a number of turns N3.

13. The device for launching and recovering a sonar as claimed in claim 10, in which, when the recovery phase is initiated and when the number of reel turns has reached the number of turns N3 and until the fish comes into abutment against the first abutment, the coupling means are configured in such a way as to uncouple the first part of the reel and the second part of the reel and the means for driving the reel are configured in such a way as to drive the first part of the reel in rotation so as to wind the towing cable around the reel.

14. The device for launching and recovering a sonar as claimed in claim 13, comprising immobilization means, suitable for immobilizing the second part of the reel relative to the frame, and in which the means for immobilizing the second part of the reel are configured in such a way as to immobilize the second part of the reel in its transfer position, when the number of reel turns has reached the number of turns N3 and until the fish comes into abutment against the first abutment.

15. The device for launching and recovering a sonar as claimed in claim 1, comprising wire guiding means comprising a wire guiding head, making it possible to guide the towing line and means for driving the wire guiding head, making it possible to move the wire guiding head parallel to the axis of rotation, the device further comprising means for driving the reel, suitable for pivoting the first part of the reel about the axis of rotation, and in which, when the recovery phase is initiated and the fish is in abutment against the first abutment, the coupling means are configured in such a way as to couple the first part and the second part of the reel and the means for driving the wire guiding head and the reel are configured in such a way as to perform a winding of the towing line around the assembly formed by the first and second parts of the reel.

16. The device as claimed in claim 8, comprising second guiding means making it possible to maintain an inclination of the fish that is fixed relative to a plane at right angles to the axis of rotation when the attachment means pass through the wire guiding head.

17. The device as claimed in claim 16, comprising third guiding means making it possible to guide and keep the fish in the housing in a predetermined direction at right angles to the axis of rotation.

18. A towing system comprising a deployment and launching device as claimed in claim 1, further comprising a linear receiving antenna and a volume transmitting antenna incorporated in the fish, and a towing line comprising a towing cable from which the fish is suspended and to which the linear antenna is secured behind the cable relative to the vessel, the towing cable being attached to said device.

* * * * *